US005334129A

United States Patent [19]

Haller

[11] Patent Number: 5,334,129

[45] Date of Patent: Aug. 2, 1994

[54] CROSS-CUTTER FOR FINAL TREATMENT OR FINISHING OF WEBS OF MATERIAL

[75] Inventor: Ralf Haller, Oftersheim, Fed. Rep. of Germany

[73] Assignee: Heidelberger Druckmaschinen AG, Heidelberg, Fed. Rep. of Germany

[21] Appl. No.: 987,027

[22] Filed: Dec. 7, 1992

[30] Foreign Application Priority Data

Dec. 7, 1991 [DE] Fed. Rep. of Germany ..... 4140365

[51] Int. Cl.[5] ..... B31F 5/02

[52] U.S. Cl. ..... 493/351; 493/390

[58] Field of Search ..... 493/350, 351, 346, 384, 493/385, 390, 392; 412/16

[56] References Cited

U.S. PATENT DOCUMENTS

| | | | |
|---|---|---|---|
| 1,179,177 | 4/1916 | Hahn | 493/392 |
| 2,935,002 | 5/1960 | Robinson, Jr. | 493/390 |
| 3,233,526 | 2/1966 | Sherman | 493/390 |
| 3,303,083 | 2/1967 | Hedenstrom | 493/346 |
| 3,517,589 | 6/1970 | Herd et al. | 493/390 |
| 3,893,359 | 7/1975 | Gregoire | 83/154 |
| 3,898,920 | 8/1975 | Zucker | 493/390 |
| 4,850,947 | 7/1989 | Brown et al. | 493/351 |

FOREIGN PATENT DOCUMENTS

| | | |
|---|---|---|
| 0110908 | 5/1983 | European Pat. Off. . |
| 347087 | 12/1989 | European Pat. Off. . |
| 7813595 | 8/1978 | Fed. Rep. of Germany . |
| 3347719 | 7/1985 | Fed. Rep. of Germany . |

*Primary Examiner*—Hien H. Phan

*Attorney, Agent, or Firm*—Herbert L. Lerner; Laurence A. Greenberg

[57] ABSTRACT

Rotary cross-cutter for final processing of at least one web of material from which excess portions have been removed includes a cross-cutting unit disposed at a given location along a travel path of the web, rotary bodies disposed at locations along the travel path upstream of the cross-cutting unit, the rotary bodies having a first device for causing webs of material to cling to one another in a direction transverse to the travel path and a second device for cutting off edge portions of the webs of material.

14 Claims, 4 Drawing Sheets

CROSS-CUTTER FOR FINAL TREATMENT OR FINISHING OF WEBS OF MATERIAL

The invention relates to a cross-cutter for final treatment or finishing of webs of material.

From the prior art, German Petty Patent or Gebrauchsmuster 78 13 595 discloses a device for cutting a paper web in a folding device. In order to prevent the corner turning as occurs with paper webs in folding units, a tacking blade is provided with three triangular points at each of its outer ends. The triangular points are located only at the edge regions of the tacking blades and act on the front or leading edge of the web immediately after a web section has been cut off. Because this device is a combined cutting/tacking device, it is not possible for paper webs of just any thickness to be processed, because the penetration depth is limited both locally and also for reasons relating to construction or design.

European Patent 0 347 087 discloses an internal cam control with the aid of which cut-out strips of paper can be located and, when the pins are driven into the interior of the cylinder, the strips of paper are released for removal by suction. This European patent does not mention how the strips of paper which are to be cut out are fixed when several multi-layer webs are to be processed.

U.S. Pat. No. 3,893,359 describes a device in which a strip which has been cut out of a web is stripped off from the circumference of a cylinder. This U.S. patent does not contain any information as to how several superimposed, cut-out paper strips are to be correctly accepted. The processing of several superimposed webs is not possible with this known device.

Furthermore, it has become known from the prior art to make the paper webs mutually adhere electrostatically. This, however, is too unreliable, because, in practice, the trimmed strips are released before they reach the designated point of extraction and adversely affect the operation of the cross-cutter.

Proceeding from the state of the art outlined hereinbefore and from the deficiencies encountered in practical use, it is an object of the invention to provide a cross-cutter for finishing webs of material which solves the technical problem relating to the safe handling of the trimming residues occurring when several webs of material are processed simultaneously, so that disruptions in production are avoided. With the foregoing and other objects in view, there is provided, in accordance with the invention, a rotary cross-cutter for final processing of at least one web of material from which excess portions have been removed, comprising a cross-cutting unit disposed at a given location along a travel path of the web, rotary bodies disposed at locations along the travel path upstream of the cross-cutting unit, the rotary bodies having first means for causing webs of material to cling to one another in a direction transverse to the travel path and second means for cutting off edge portions of the webs of material.

The achievable advantages of this construction are that the individual strips resulting from the cross-cutting operations on the multi-layer web of material are able to be removed, prior to the cross-cutting operation, in the form of one strip of material formed of a multiplicity of individual strips. This ensures the removal from the transport plane of those layers of the web of material also which are farthest from the blade roller.

The removal of the excess or surplus portions is effected at defined places by means of extraction, thereby increasing the operational reliability of the cross-cutter and decisively improving the accuracy of delivery.

In accordance with another feature of the invention, the first means of the rotary bodies comprise a device for penetrating the webs of material, and an anvil cooperatively engageable with the penetrating device. This ensures that all of the layers of the web of material are held or cling together, prior to the cross-cutting operation, at one location. This improves the accuracy of the subsequent cross-cutting operation due to the expulsion of the air which was enclosed between the webs of material.

In accordance with a further feature of the invention, the web travel path is substantially horizontal, and the penetrating device is displaceable in a substantially vertical direction for penetrating the webs of material substantially perpendicularly to the web travel path.

In accordance with a greater detail of the invention, the penetrating device is displaceable upwardly from below the web travel path.

In accordance with an alternative feature of the invention, the penetrating device is displaceable downwardly from above the web travel path.

In line with specific production requirements, this makes it possible to promote the extraction of the strip of material which is formed of individual strips, subsequent to the cross-cutting operation, depending upon whether extraction takes place above or below the webs of material.

In accordance with an added feature of the invention, the penetrating device is disposed on the rotary bodies and extends in a direction transverse to the web travel path.

In accordance with an alternative feature of the invention, the penetrating device is disposed on the rotary bodies and extends in the same direction as the web travel path.

The advantageous effect lies in the fact that, in addition to treatment in the transverse direction of the layers of the web of material, treatment is afforded also to the open sides of the web of material, opposite the longitudinal fold, in order to improve further processing.

In accordance with yet another feature of the invention, the rotary bodies are formed with respective grooves, and respective carriers are mounted in the grooves and carry the penetrating device.

In accordance with a detail of the foregoing construction of the invention, the carriers are strip-shaped.

In accordance with an alternative feature of the invention, the carriers are ring-shaped.

Consequently, the means for penetrating the webs of material can be set up while they are still outside the machine; when there is a job change, the profiled or ring-shaped carriers which carry the penetrating means can be mounted with just a few manual operations and in a short set-up time. Depending upon the job, the carriers can be equipped with means for penetrating the webs of material which either extend across the width or over the circumference thereof, as required by the particular job.

In accordance with yet an added feature of the invention, the first means comprise a penetrating device for penetrating the webs of material and withdrawing therefrom, the penetrating device being formed with means for locally pulling an upper web of material through the lower webs of material so that the webs of material cling locally together when the penetrating device is withdrawn from the webs of material.

In accordance with yet an additional feature of the invention, the first means comprise a penetrating device formed of pins.

In accordance with another feature of the invention, the pins have roughened surfaces.

In accordance with a further feature of the invention, the first means comprise a penetrating device formed of needles having rings mounted thereon.

In accordance with a concomitant feature of the invention, the first means comprise a penetrating device having needles formed with barbs.

Other features which are considered as characteristic for the invention are set forth in the appended claims.

Although the invention is illustrated and described herein as embodied in a cross-cutter for the finish-treating of webs of material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

The invention is explained in greater detail below with reference to the drawings, in which:

FIG. 1 is a diagrammatic side elevational view of a cross-cutter constructed in accordance with the invention;

FIGS. 2 and 2*a* are enlarged fragmentary views of FIG. 1 showing different embodiments of the rotary bodies thereof in greater detail;

Figure 1:
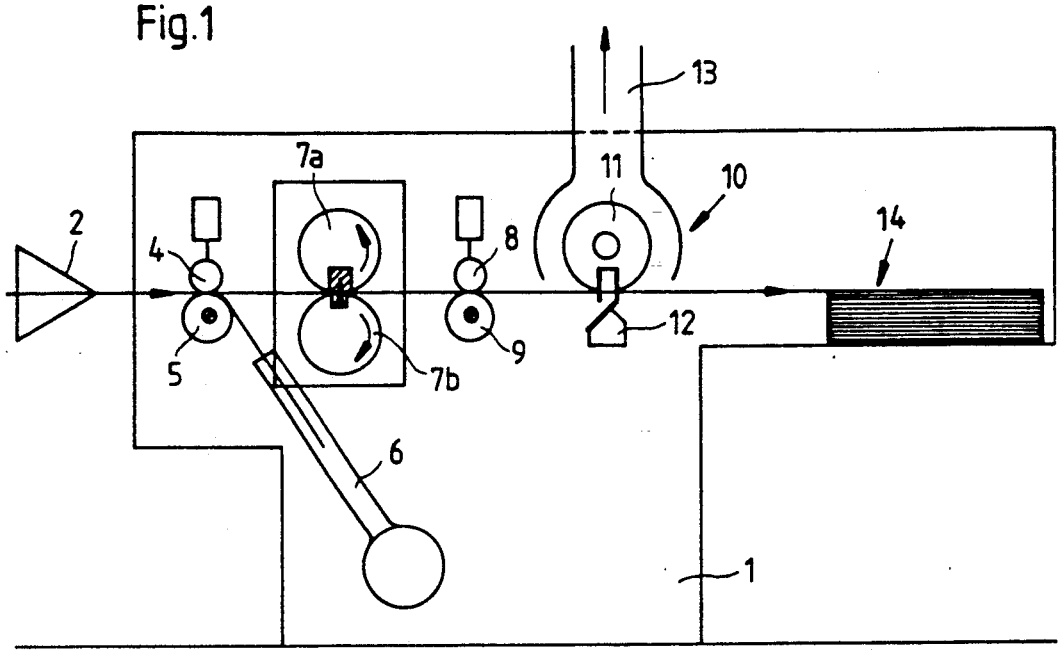
Figure 2:
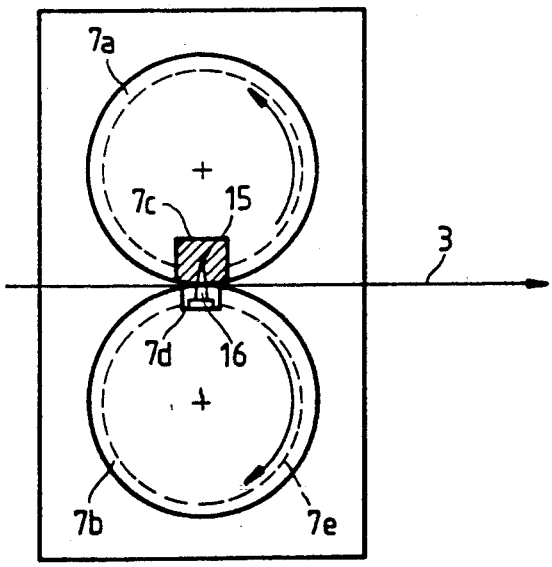
Figure 2A:
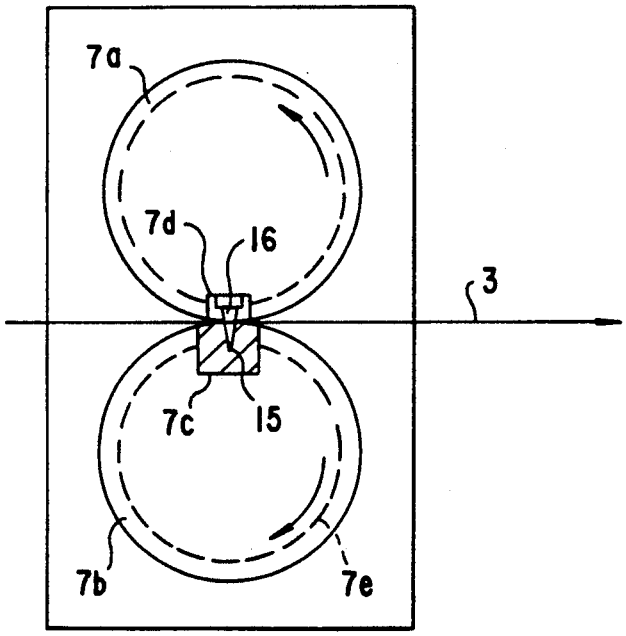

Referring now to the drawings and, first, particularly to FIG. 1 thereof, there is shown therein, at a location down-stream from a cross-cutter 1 along a travel path of at least one web of material, a pre-folding unit 2 in which one or more webs of material 3 are longitudinally folded. Thereafter, the webs of material 3, mutually superimposed, enter the cross-cutter 1, where the webs of material 3 are gripped by driven transport rollers 5, above which a longitudinal cutting apparatus 4 is disposed. The longitudinal cutting apparatus 4 performs side trimming of the webs of material 3. The longitudinal cutting blades thereof are flexibly or resiliently engaged with the transport roller 5. Portions of the webs of material 3 which are cut off during the longitudinal cutting operation enter extraction ducts 6 so that they do not adversely affect further processing of the webs of material 3 in the cross-cutter 1. As viewed in the transport direction of the webs of material 3, a pair of rotary bodies 7*a* and 7*b*, which act upon the web of material 3, are situated downline of the longitudinal cutting apparatus 4. Enlarged representations of different embodiments the rotary bodies 7*a* and 7*b* are shown in FIGS. 2 and 2*a*. On the circumference of the rotary bodies 7*a* and 7*b*, respectively, in FIG. 2, an anvil strip 15 and means for penetrating the webs of material 3, for example, pins 16, are located. The pins 16 may be distributed in axial direction across the entire extent of the rotary body 7*b*. Similarly, the anvil strip 15 may extend across the entire width of the rotary body 7*a*. In FIG. 2*a*, on the other hand, the pins are distributed across the rotary body 7*a*, and the anvil strip 15 across the rotary body 7*b*. If it is desired to treat edge regions of webs of material 3 in the longitudinal direction, for example, at the open side of the web opposite the longitudinal fold, then it is possible, for example, for the pins 16 to be distributed in a star-shaped configuration over the circumference of the rotary body 7*b*. In this case, the anvil strip 15 (FIG. 3) would be ring-shaped and would be received in a circumferential groove 7*e* instead of in a longitudinal groove 7*c* in the rotary body 7*a*. When the webs of material 3, mutually superimposed, simultaneously enter the gap between the rotary bodies 7*a* and 7*b*, the webs of material 3 are penetrated, either from top to bottom or from bottom to top, depending upon the configuration, by the means for penetrating the webs 3, i.e., in this case, by the pins 16. As the rotary bodies 7*a* and 7*b* roll on each other, the pins 16 wholly penetrate the superimposed webs of material 3 until the points of the pins 16 strike the anvil strip 15. As the outer cylindrical surfaces of the rotary bodies 7*a* and 7*b* continue to roll on each other, the points of the pins 16 are gradually withdrawn from the superimposed webs of material 3 and pull the upper layers of the web of material 3 through the lower layers of the web of material. The webs of material 3, which continue to be transported in mutually superimposed relationship, are joined locally to one another in this manner. Such joining occurs in the center of the region which is cut out from the webs of material 3 in the cross-cutting unit 10 by a double-blade roller 11.

After passing the rotary bodies 7*a* and 7*b*, the webs of material 3 are transported further by a another transport roller 9 and by a pressure roller 8, which is subjected to a compressive force. A cut transverse to the transport direction of the webs of material 3 is effected in the aforementioned cross-cutting unit 10. The regions which are cut out of the webs of material 3 by the double blade of the double-blade roller 11 are joined together centrally by means of the preceding operation. The cut by the engaged lower blade 12 of the double blade of the double-blade roller 11 detaches, from the webs of material 3*a*, a strip of material which is actually made up of a multiplicity of held-together individual strips of the superimposed webs of material 3. The strip of material formed of individual strips enters the extractor 13 and ceases to have a detrimental impact on the further transport of the copies which have been finish-cut from the webs of material 3. The separation of the joining operation on the webs of material 3 from the cutting operation assures the achievement of a higher production output as well as increased operational reliability of the cross-cutter.

Figure 3:
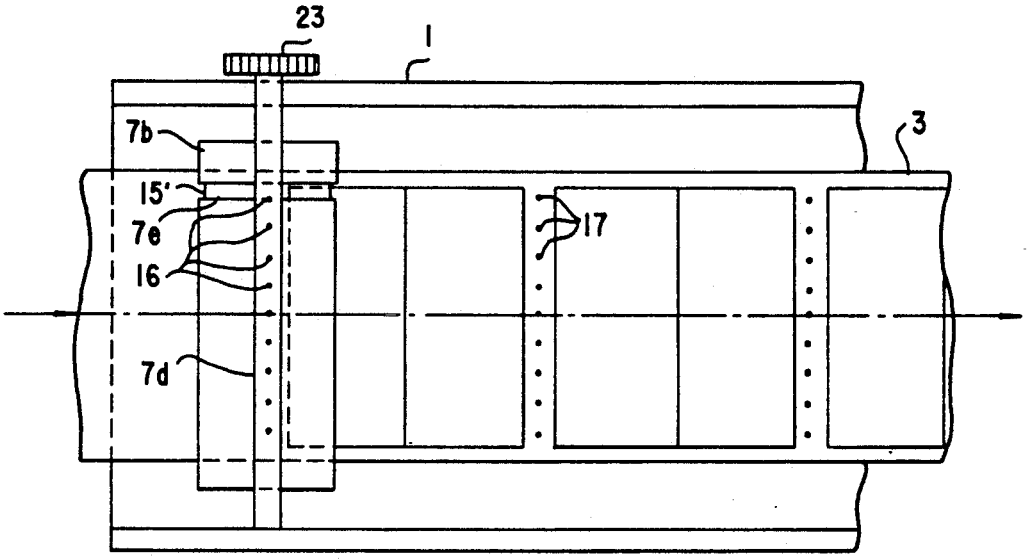
FIG. 3 is an enlarged fragmentary plan view of FIG. 1 showing another embodiment of the cross-cutter for processing superimposed webs of material.

FIG. 3 shows another embodiment of the cross-cutter for processing mutually superimposed webs of material 3.

It is possible, in this top plan view, to discern, on the rotary body 7*b*, the points of the pins 16 which impress points of penetration 17 on the webs of material 3. The points of penetration 17 are situated centrally in those regions which will be cut out in the subsequent cross-cutting operation. The drive is by means of a driving gear 23 and is in synchronism and in correct cutting register with the drive of the cross-cutting unit 10 of the cross-cutter 1.

Figure 4:
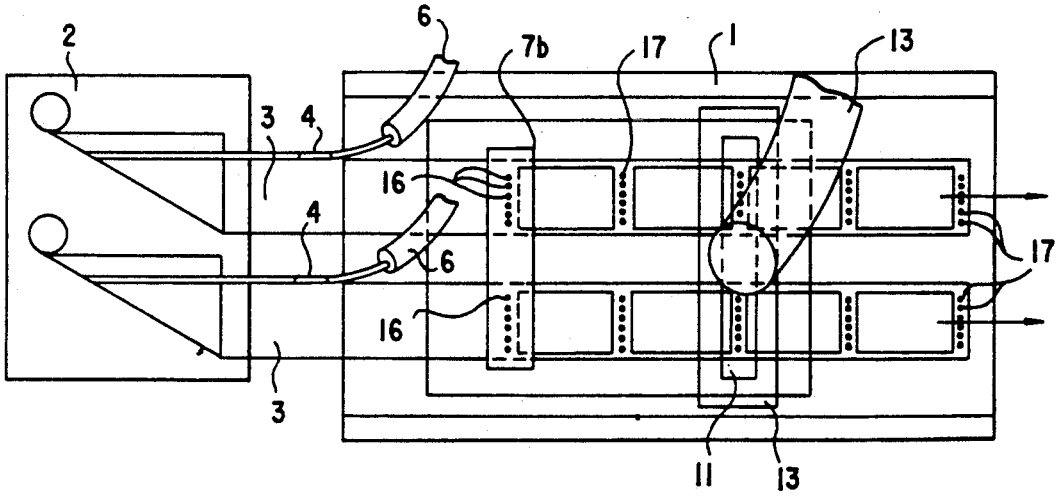
FIG. 4 is an enlarged fragmentary plan view of FIG. 1 showing a further embodiment of the cross-cutter for processing mutually adjacent, pre-folded webs of material.

FIG. 4 shows a further embodiment of the cross-cutter for processing a plurality of mutually adjacent or juxtaposed, pre-folded webs of material. In this configuration, rotary body *7a* and double-blade roller 11 extend across two webs of material 3. Said webs of material 3 shown here may, in turn, consist of superimposed webs of material 3. After pre-folding in the pre-folding unit 2, each web of material 3 is treated by a longitudinal cutting apparatus 4, which is associated with an extraction duct 6. In this configuration, the pins 16 are distributed only over a specific region of the width of the webs of material 3. The extractor 13 is likewise dimensioned in such a manner as to cover both webs of material, in order to extract and to carry away the strips of material, which consist of individual strips.

Figure 5:
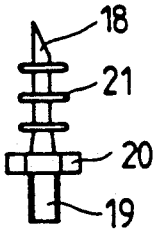
FIGS. 5 and 6 are longitudinal views of different embodiments of penetration devices, respectively, formed as as a ring needle and a needle having a barb.
Figure 6:
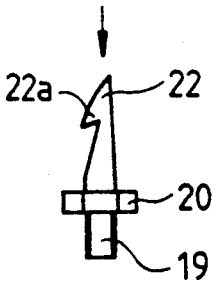
Figure 6A:
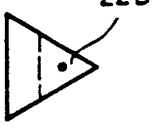
FIG. 6*a* is an enlarge representation of the triangular outline of the barbed needle of FIG. 6.

FIGS. 5 and 6 show embodiments of means for penetrating webs of material.

FIG. 5 shows a ring needle 18, which has a sharp insertion point. Disposed below the insertion point are a plurality of rings 21 which, when the webs of material 3 are penetrated and when the insertion point is subsequently withdrawn, cause the individual layers of the webs of material 3 to cling together. The needle configuration makes it possible, for example, to handle thin webs of material. A shoulder 20 has a common width across flats, so that the ring needle 18 can be fastened and easily exchanged by means of a thread 19 formed on the rotation body *7b*.

In addition to individually mounting the penetrating means, it is also possible for the means to be installed on a rail or strip which is then introduced into an appropriate groove, the rail being made-ready outside the machine and being capable of being rapidly changed over whenever there is a job change.

FIG. 6 shows a needle 22 formed with barbs *22a*. When the point of the needle 22 is in contact with the anvil strip 15 (which is opposite the needle 22 during operation), the webs of material 3 are pressed together and are fixed by the barb *22a*. When the barbed needle 22 is withdrawn from the layers of the webs of material 3, this effects the mutual joining of the individual webs of material 3. The barb *22a* successively pulls the layers of the individual webs of material 3 locally from top to bottom and holds the webs of material together at the point of penetration 17. This needle configuration is provided likewise with shoulders 20 and a thread 19, thereby permitting pre-assembly both inside and outside the cross-cutter 1. The cross section *22b* of FIG. *6a* is an enlarged representation of the triangular outline of the needle 22.

The foregoing is a description corresponding in substance to German Application P 41 40 365.7, dated Dec. 7, 1991, the International priority of which is being claimed for the instant application, and which is hereby made part of this application. Any material discrepancies between the foregoing specification and the aforementioned corresponding German application are to be resolved in favor of the latter.

I claim:

1. In a printing press, a rotary cross-cutter for final processing of a plurality of mutually superimposed webs of material having print-free locations thereon from which excess portions have been removed, comprising a cross-cutting unit disposed at a given location along a travel path of the webs, rotary bodies disposed at locations along said travel path upstream of said cross-cutting unit, at least one of said rotary bodies having first means for causing the webs of material to cling to one another at the print-free location of the mutually superimposed webs in a direction transverse to said travel path and at least another of said rotary bodies having second means for cutting off edge portions of the webs of material.

2. Rotary cross-cutter according to claim 1, wherein said first means of said rotary bodies comprise a device for penetrating the webs of material, and an anvil cooperatively engageable with said penetrating device.

3. Rotary cross-cutter according to claim 2, wherein the web travel path is substantially horizontal, and said penetrating device is displaceable in a substantially vertical direction for penetrating the webs of material substantially perpendicularly to the web travel path.

4. Rotary cross-cutter according to claim 3, wherein said penetrating device is displaceable upwardly from below the web travel path.

5. Rotary cross-Cutter according to claim 3, wherein said penetrating device is displaceable downwardly from above the web travel path.

6. Rotary cross-cutter according to claim 2, wherein said penetrating device is disposed on said rotary bodies and extends in a direction transverse to the web travel path.

7. Rotary cross-cutter according to claim 2, wherein said rotary bodies are formed with respective grooves, and including respective carriers mounted in said grooves and carrying said penetrating device.

8. Rotary cross-cutter according to claim 7, wherein said carriers are strip-shaped.

9. Rotary cross-cutter according to claim 7, wherein said carriers are ring-shaped.

10. Rotary cross-cutter according to claim 1, wherein said first means comprise a penetrating device formed of pins.

11. Rotary cross-cutter according to claim 10, wherein said pins have roughened surfaces.

12. Rotary cross-cutter for final processing of a plurality of mutually superimposed webs of material from which excess portions have been removed, comprising a cross-cutting unit disposed at a given location along a travel path of the webs, rotary bodies disposed at locations along said travel path upstream of said cross-cutting unit, at least one of said rotary bodies having first means for causing the webs of material to cling to one another in a direction transverse to said travel path and at least another of said rotary bodies having second means for cutting off edge portions of the webs of material, said first means comprising a penetrating device for penetrating the webs of material and withdrawing therefrom, said penetrating device being formed with means for locally pulling an upper web of material through the lower webs of material so that the webs of material cling locally together when said penetrating device is withdrawn from the webs of material.

13. Rotary cross-cutter for final processing of a plurality of mutually superimposed webs of material from which excess portions have been removed, comprising a cross-cutting unit disposed at a given location along a travel path of the webs, rotary bodies disposed at locations along said travel path upstream of said cross-cutting unit, at least one of said rotary bodies having first means for causing the webs of material to cling to one another in a direction transverse to said travel path and at least another of said rotary bodies having second means for cutting off edge portions of the webs of material, said first means comprising a penetrating device formed of needles having rings mounted thereon.

14. Rotary cross-cutter for final processing of a plurality of mutually superimposed webs of material from which excess portions have been removed, comprising a cross-cutting unit disposed at a given location along a travel path of the webs, rotary bodies disposed at locations along said travel path upstream of said cross-cutting unit, at least one of said rotary bodies having first means for causing the webs of material to cling to one another in a direction transverse to said travel path and at least another of said rotary bodies having second means for cutting off edge portions of the webs of material, said first means comprise a penetrating device having needles formed with barbs.

* * * * *